US007950077B2

(12) United States Patent
Santamarina et al.

(10) Patent No.: US 7,950,077 B2
(45) Date of Patent: May 31, 2011

(54) SPA JET YIELDING INCREASED AIR ENTRAINMENT RATES

(75) Inventors: Aland Santamarina, Columbia, MD (US); Alan S. Romack, Columbia, MD (US); Shawn Martin, Annapolis, MD (US)

(73) Assignee: Bowles Fluidics Corporation, Columbia, MD (US)

( * ) Notice: Subject to any disclaimer, the term of this patent is extended or adjusted under 35 U.S.C. 154(b) by 1206 days.

(21) Appl. No.: 11/633,933

(22) Filed: Dec. 5, 2006

(65) Prior Publication Data

US 2007/0124856 A1 Jun. 7, 2007

Related U.S. Application Data

(60) Provisional application No. 60/742,290, filed on Dec. 5, 2005.

(51) Int. Cl.
*A61H 33/04* (2006.01)

(52) U.S. Cl. ..... 4/541.6

(58) Field of Classification Search ..... 4/541.4, 4/541.6; 239/318, 589.1; 261/77, 121.1, 261/DIG. 75

See application file for complete search history.

(56) References Cited

U.S. PATENT DOCUMENTS

| | | | | |
|---|---|---|---|---|
| 2,632,597 | A * | 3/1953 | Boeckeler | 261/DIG. 75 X |
| 3,716,194 | A * | 2/1973 | Miller | 239/318 |
| 4,119,686 | A | 10/1978 | Conger et al. | 261/77 |
| 4,320,541 | A | 3/1982 | Neenan | 4/492 |
| 4,542,854 | A | 9/1985 | Mathis | 239/587 |
| 4,896,384 | A | 1/1990 | Dijkhuizen | 4/542 |
| 5,495,627 | A | 3/1996 | Leaverton et al. | 4/541.6 |
| 5,829,069 | A | 11/1998 | Morgan et al. | 4/493 |
| 5,876,639 | A * | 3/1999 | Campau | 261/121.2 X |
| 5,920,925 | A | 7/1999 | Dongo | 4/541.6 |
| 6,052,844 | A | 4/2000 | Walsh et al. | 4/541.1 |
| 6,322,004 | B1 | 11/2001 | Perdreau et al. | 239/428.5 |
| 6,328,222 | B1 | 12/2001 | Warner et al. | 239/5 |
| 6,497,375 | B1 | 12/2002 | Srinath et al. | 239/589.1 |
| 6,575,386 | B1 | 6/2003 | Thurber et al. | 239/418 |
| 6,729,564 | B2 | 5/2004 | Srinath et al. | 239/589.1 |
| 6,859,953 | B1 | 3/2005 | Christensen | 4/541.1 |
| 6,904,626 | B1 | 6/2005 | Hester et al. | 4/541.6 |
| 6,948,244 | B1 | 9/2005 | Crockett | 29/890.142 |
| 7,070,129 | B1 * | 7/2006 | Raghu et al. | 239/589.1 |
| 2004/0261171 | A1 | 12/2004 | Hotsnider et al. | 4/541.6 |

* cited by examiner

*Primary Examiner* — Lori Baker
(74) *Attorney, Agent, or Firm* — J. A. McKinney, Jr.

(57) ABSTRACT

An improved spa nozzle that is capable of entraining high air flow rates from the surrounding environment, said nozzle of the type having a water input conduit of diameter D, a flow output conduit having entry and diameter of DID, a transition conduit having a diameter of ID and a length of PL, and an air entrainment conduit, and wherein the following ratios are defined to describe the relative geometry of the nozzle: $\alpha$=PL/(DID−ID), $\beta$=DID/ID and $\gamma$=D/ID, the improvement comprising: the water input, transition and output conduits being configured such that $\alpha$ is in the range of 1.3-5 and $\beta$ is>1.9.

15 Claims, 11 Drawing Sheets

SPA JET YIELDING INCREASED AIR ENTRAINMENT RATES

CROSS-REFERENCE TO RELATED APPLICATION

This application claims the benefit of Provisional Patent Application No. 60/742,290 filed Dec. 5, 2005 by Aland Santamarina. The teachings of this application are incorporated herein by reference to the extent that they do not conflict with the teaching herein.

BACKGROUND OF THE INVENTION

1. Field of the Invention

This invention relates to fluid handling processes and apparatus. Although the present invention is subject to a wide range of application, it is especially well suited for use as a spa nozzle or jet to create submerged, extremely-highly-aerated water jets in baths, whirlpools and spas. It will be primarily described in this connection.

2. Description of the Related Art

Various fluid flow applications entail the mixing of liquids and gases. For example, hot tubs, whirlpools and spas typically have one or more, under-water nozzles or jets.

Many of these nozzles can be configured to entrain air from the surrounding environment so as to exhaust a submerged aerated water jet (i.e., a water jet having a multitude of air bubbles that are created by its entrained air). Such jets have become very important in the hydrotherapy industry because they are seen to create fluid flow patterns in a pool that can provide a pool user with tactile sensations upon which a pool, spa or tub buying decision can be made.

The relative amount of air that can be entrained by a spa jet or nozzle for a given water flow rate is now becoming an important criteria by which such devices can evaluated.

Various types of fluid flow aerators, including Venturi air entrainment devices, have been used in the hydrotherapy or spa industry. For example, see U.S. Pat. Nos. 4,119,686, 4,320,541, 4,542,854, 4,896,384, 5,829,069, 5,920,925, 6,052,844, 6,322,004, 6,328,222, 6,497,375, 6,575,386, 6,729,564, 6,859,953, 6,948,244, and 6,904,626 and U.S. Patent Application Publication Number US2004/0261171.

An experimental evaluation of some of the more widely utilized spa nozzle or jets has revealed that most of these devices yield ratios of air volumetric entrainment rates to water volume flowrates, $E=Q_A/Q_W$, which are only in the range of 0.3 to 1.5 over a range of water input pressures of 2 to 20 pounds per square inch (psi). The opportunity exists for developing spa nozzles or jets that can provide greater air entrainment rates. Additionally, there is a need for improved means for controlling the characteristics of the flows that are exhausted by such devices.

3. Objects and Advantages

There has been summarized above, rather broadly, the prior art that is related to the present invention in order that the context of the present invention may be better understood and appreciated. In this regard, it is instructive to also consider the objects and advantages of the present invention.

It is an object of the present invention to provide an improved spa jet which is capable of entraining larger relative quantities of air into the water that is flowing through such jets.

It is also an object of the present invention to demonstrate various ways for temporally controlling the exhausts from such spa jets.

It is a further object of the present invention to provide a fluid flow device for use with hot tubs, whirlpools and spas that can extend the range of flow patterns that can be imposed in such pools so as to provide a wider range of tactile sensations for the user of such a pool.

These and other objects and advantages of the present invention will become readily apparent as the invention is better understood by reference to the accompanying summary, drawings and the detailed description that follows.

SUMMARY OF THE INVENTION

Recognizing the need for the development of improved spa jets or nozzles, the present invention is generally directed to satisfying the needs set forth above and overcoming the limitations seen in the prior art devices and methods.

In accordance with the present invention, an improved spa nozzle or jet which is capable of entraining comparatively large amounts of air includes in a first preferred embodiment: (a) a water input conduit of diameter D, (b) a flow output conduit having entry diameter of DID, (c) a transition conduit having a diameter of ID and a length of PL, and (d) an air entrainment conduit, and wherein the following ratios are defined to describe the relative geometry of the nozzle: $\alpha=PL/(DID-ID)$, $\beta=DID/ID$ and $\gamma=D/ID$, the improvement comprising: the water input, transition and output conduits being configured such that $\alpha$ is in the range of 1.3-5 and $\beta$ is>1.9.

In a second preferred embodiment, this improved spa nozzle further includes a fluidic oscillator configured to have a power nozzle and two outlet conduits downstream of the power nozzle and one or more control ports proximate the power nozzle and attached to it so as to control the downstream flow of liquid through it, and wherein one of the oscillator's outlet conduits being connected to the spa nozzle's air entrainment conduit.

Thus, there has been summarized above, rather broadly and understanding that there are other preferred embodiments which have not been summarized above, the present invention in order that the detailed description that follows may be better understood and appreciated. There are, of course, additional features of the invention that will be described hereinafter and which will form the subject matter of the later presented claims to this invention.

DESCRIPTION OF THE PREFERRED EMBODIMENT

Figure 1:
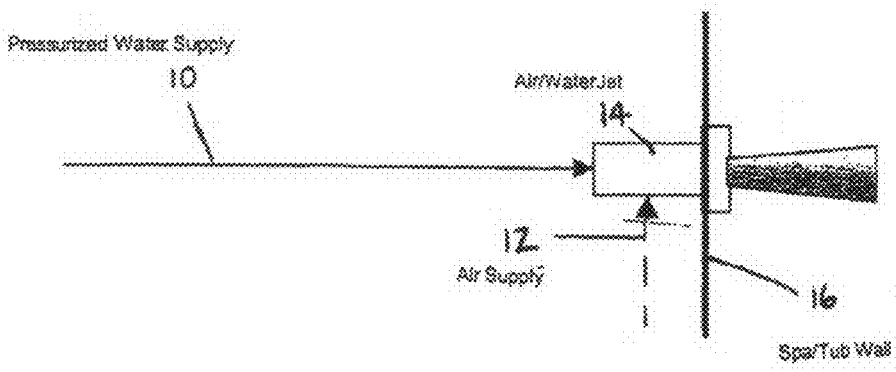
FIG. 1 illustrates the typical plumbing setup that is used to feed a submerged air/water jets that is embedded in a sidewall of a hot tub, spa, whirlpool, etc.

Before explaining at least one embodiment of the present invention in detail, it is to be understood that the invention is not limited in its application to the details of construction and to the arrangements of the components set forth in the following description or illustrated in the drawings. The invention is capable of other embodiments and of being practiced and carried out in various ways.

Also, it is to be understood that the phraseology and terminology employed herein are for the purpose of description and should not be regarded as limiting. For example, the discussion herein below generally relates to water and air mixing techniques; however, it should be apparent that the inventive concepts described herein are applicable also to the mixing of other fluids.

As previously mentioned, the present invention is applicable in a wide range of fluid flow applications where it is desired to mix fluids by initially having the flow of one fluid entrain into it a second fluid. This technology is especially well suited for use as a spa nozzle or jet to create submerged, extremely-highly-aerated water jets in baths, whirlpools and spas. It will be described below in this context.

FIG. 1 shows the typical piping system for use in the hydrotherapy industry with, for example, hot tubs, whirlpools and spas. A pressurized water supply 10 feeds a submerged spa jet or nozzle 14 whose exit is affixed to the wall 16 of a hydrotherapy pool. This nozzle has an opening to the surrounding environment that allows the water flowing through the nozzle to entrain air 12 that mixes with the water to form an aerated water jet that is exhausted into the hydrotherapy pool. The resulting flow into the pool typically appears as a white, opaque, bubble-filled stream.

Control of the input flows to such a jet is very important since such jets are what establish the flow patterns in the spa or hot tub that ultimately establish the tactile sensations experienced by a pool user. These tactile sensations, and the pool flow patterns which cause them, are important because they can be a critical factor on which a potential spa or hot tub purchaser would make a decision to choose between alternative spas and hot tubs in the marketplace. Consequently, the manufacturers of such equipment are often searching for ways to extend the range of pool flow patterns and flow phenomena that can be achieved using their equipment.

Recognizing the need to extend the range of such equipment, we experimentally examined the air entrainment phenomena in such devices. We then set about building and experimentally trialing different means for changing the flow geometry through said devices so as to increase their air entrainment rates.

Figure 2:
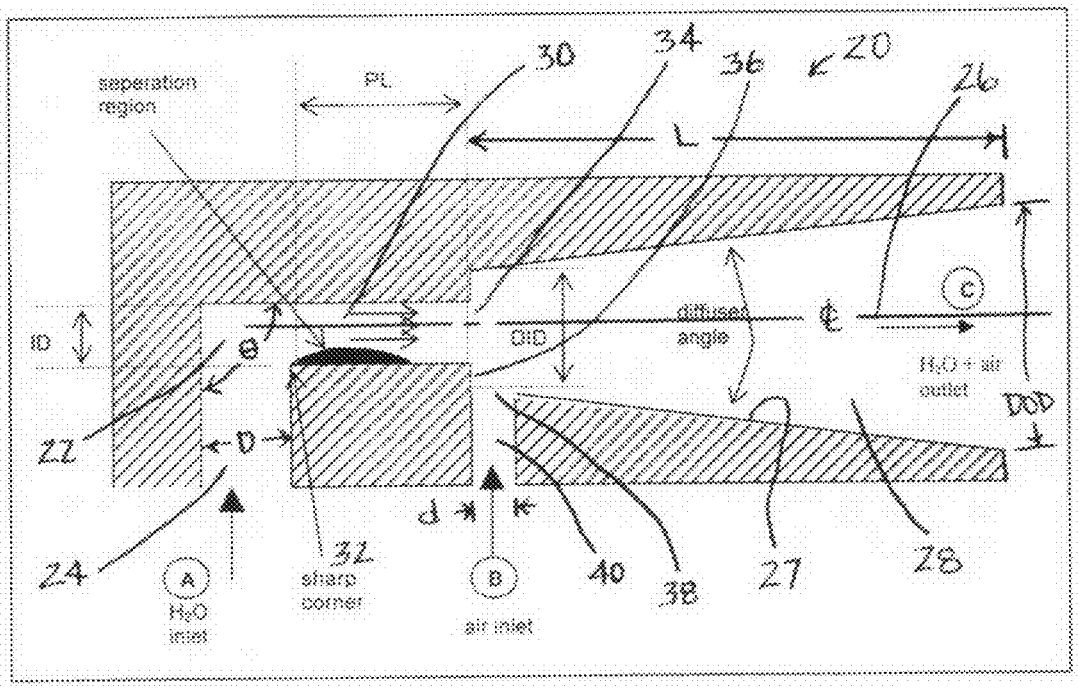
FIG. 2 shows a preferred embodiment of the present invention.

FIG. 2 shows a preferred embodiment for a spa jet or nozzle 20 that we have found can yield approximately twice the relative air entrainment rates of any of the presently available commercial spa jets that we tested. The view shown is a cross-sectional view of the assumed circular pipe sections that make up this preferred embodiment.

The key geometric details to be noted in this new spa jet include: (a) the use of a sharp turn 22 (which is shown in FIG. 2 as a right angle, $\theta$=90 degrees) to bring the water supply 24 in a pipe or conduit of diameter or characteristic dimension D to the centerline 26 of the device and where the pipe and device centerline intersect at an angle defined herein as $\theta$, (b) an output conduit or section 28 which has an entry having a diameter of DID, an exit having a diameter DOD and a length L and which is shown here as a diffuser 28 which is used to direct the flow from the device into the adjoining pool on whose sidewall the nozzle 20 is attached, (c) a connecting or transition conduit or section 30 which as shown here consists essentially of a straight or slightly diverging (i.e., divergence angle<3 degrees) length of pipe of diameter (characteristic cross-sectional area dimension) ID and length (characteristic length dimension) PL, which connects the inside, sharp corner or edge 32 which is formed where this pipe meets the water's input pipe and the beginning or entry 34 of the downstream diffuser 28 (i.e., sharp—the intersecting walls of the water and transition pipes come together at a point with an intersection angle that is approximately 90 degrees or larger), (d) an abrupt expansion 36 in the diameter of the pipe at the entry to the diffuser, where this pipe's diameter increases from a value of ID to the value of DID, and (e) the outlet orifice or port 38 of the air input pipe or conduit 40 of diameter (characteristic cross-sectional area dimension) d which is located at or adjacent and downstream of this abrupt pipe expansion at the diffuser's entry.

By configuring the geometry of the various elements of this diffuser we were able to experimentally observe the flow through an assortment of variously scaled models of such spa nozzles, we discovered certain models that gave surprisingly large rates of entrained air. Recall that the ratio of the air volumetric entrainment rate to the water volume flowrate, E, has previously been observed to be in the range of 0.3 to 1.5 for most spa nozzles. For our best performing models, we measured air entrainment rates that equated to this flow ratio E being in the range of from 2 to 4.

Figure 3A:
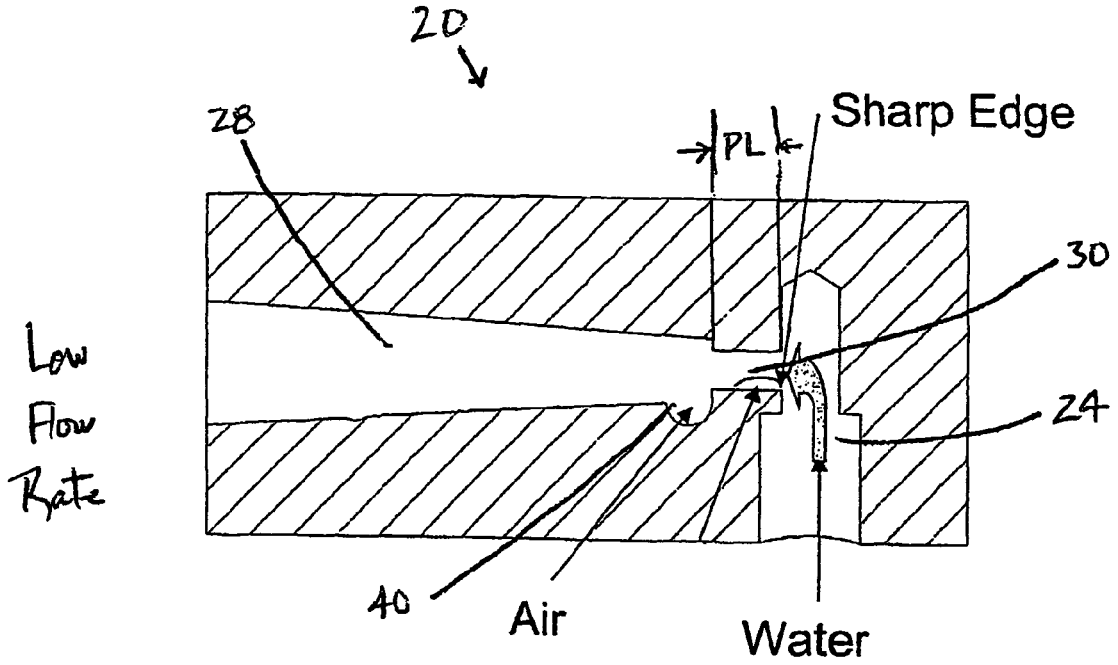
FIGS. 3A and 3B illustrate the phenomena of the growth of a flow separation region downstream of the sharp corner of the embodiment shown in FIG. 2 when the water flowrate through the embodiment increases.
Figure 3B:
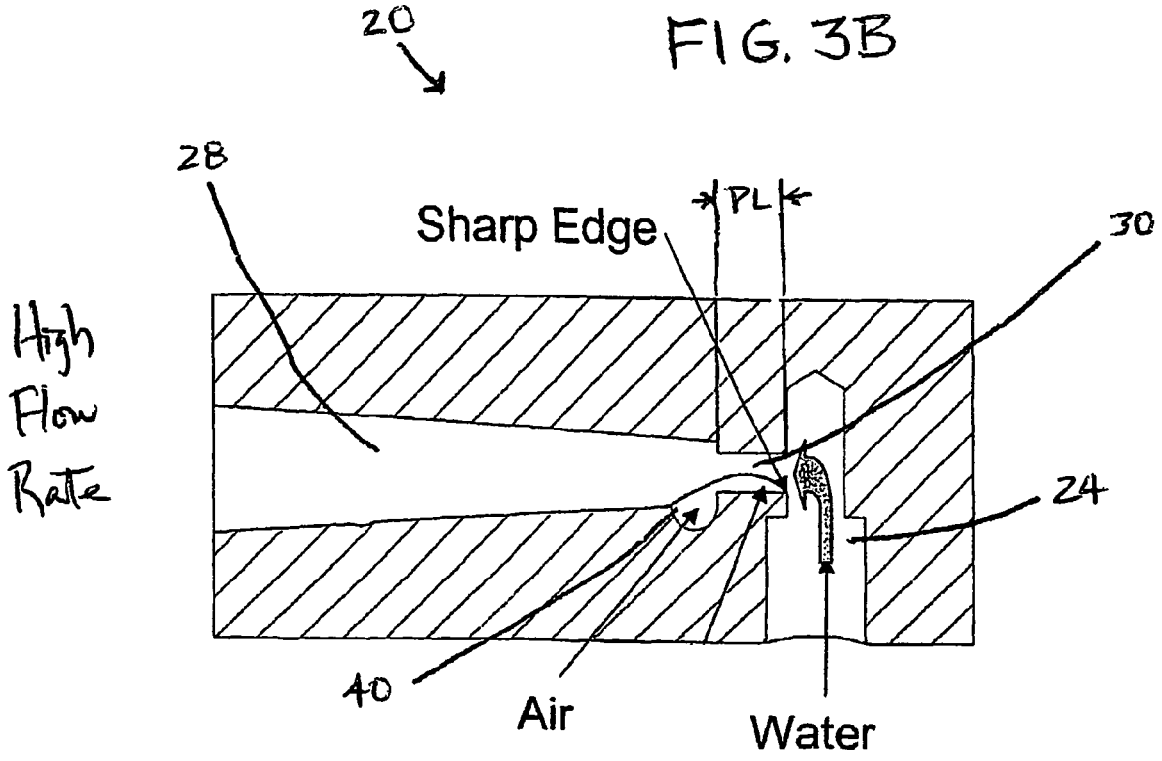

For example, we observed that a sharp turn or bend in the water inlet pipe and a resulting sharp edge 32 on the inside of the turn yielded a flow separation region at this sharp edge that was beneficial for yielding higher air entrainment rates. As the water flow rate continued to increase, this separation region was observed to grow in its downstream extent. See FIGS. 3A and 3B.

In order to achieve high air entrainment ratios (i.e., E>2), it appears vital for the free jet that issues from the exit of the transition conduit to be able to expand in the output conduit which serves as an effective "expansion chamber".

Additionally, it is well accepted that a free jet containing large-scale vortices in its shear layer will have a greater expansion potential because the vortices are the mechanism for transferring water from the core of the jet to the outer-walls. More expansion leads to larger jet surface area in contact with air, thus more air can be grabbed. The question then becomes how can a free jet be conditioned upstream so as to increase its expansion potential?

This logic set us about the task of trying to find an upstream method or means for generating more large-scale vortices in the shear layers of output conduit's free jet in order to achieve more air entrainment. One upstream method or means that we have discovered to promotes or generate vorticity in the flow is the use of a right turn in the water inlet conduit followed by a relatively straight transition conduit. While there may be some necking down of the water inlet conduit's cross-sectional area upstream of the turn, there is no further constriction of the water flow through the transition conduit (i.e., the transition conduit has a relatively constant cross-sectional area at all points along its length). Transition conduits that further constricted and accelerated the flow were found to yield only relatively low air entrainment rates (i.e., 0.3, E<1.5). We have concluded that our water inlet conduit right turn followed by a relatively straight transition conduit is an effective means for converting linear kinetic energy to rotational energy (vorticity). The presence of this considerable vorticity in the boundary layer downstream from the turn will become large-scale vortices in the free jet's shear-layer once in the outlet conduit. It should be noted that other methods or means of creating or generating this desired excess vorticity in the water flowing through the transition conduit are well known in the art and are considered to come within the scope of the present invention.

We also observed that care had to be taken to not make the diameter of the output conduit at it downstream end so large that the boundaries of the expanding free jet that issues from the transition conduit do not touch the adjoining sidewalls before the jet exits the nozzle. The situation wherein the jet's expanding boundaries do not touch the adjoining sidewalls was found to allow water, from the pool into which the nozzle exhausts, to flow back into the conduit. This flow condition was observed to significantly decrease the nozzle's air entrainment rate.

While the embodiment in FIG. 2 shows one embodiment and a possible geometrical arrangement for creating such flow phenomena, those knowledgeable in the field of fluid mechanics and other industrial fluid flow applications (e.g., other devices which cannot accommodate an upstream right angle in the inlet liquid's pipe line) for gas entrainment will obviously see other geometrical arrangements which can also give the desired flow phenomena (e.g., abrupt protrusions extending in from the pipe's walls which can create separation regions behind such protrusions; the air input orifice can be aligned parallel to the diffuser's centerline). All of these embodiments are considered to come within the scope of the current invention.

For a given water flowrate through the embodiment shown in FIG. 2, it is thought that certain geometric parameters can be used to configure a spa nozzle that will give the desired higher air entrainment rates. For example, the following ratios:

- $\alpha$=PL/(D−ID), ratio of the transition conduit's (i.e., pipe that is prior to the outlet conduit's entrance) length to the diameter restriction it imposes,
- $\beta$=DID/ID, ratio of the diameter of the outlet conduit at its entry to that of the transition conduit, and
- $\gamma$=D/ID, ratio of the diameter of the water input pipe to that of the transition conduit, can be used to describe the required spa nozzle geometry required to give high air entrainment rates where we have a sharp corner (note: it need not be precisely 90 degrees, it need be only such as to create the flow separation region at its sharp corner) at the water's inlet and when the air input orifice is proximate the diffuser's entry (note: the air input orifice can be further downstream or possibly even somewhat upstream, the important point is that it be located in the region where the two flow separation regions interact).

As an example of using such design parameters, it can be noted that for a typical spa jet operating at a water inlet pressure of 10-13 psi and using pipes such that D=0.15 inches, ID=0.17 inches, DID=DOD=0.44 inches and d=0.25 inches, an embodiment similar to that shown in FIG. 2 has been shown to yield air entrainment rates which are more than twice that of the nozzle's water flowrate (i.e., E=2) when $\alpha$ is in the range of 1.3-5 (preferred value=1.7) and $\beta$ is >1.9.

Figure 4A:
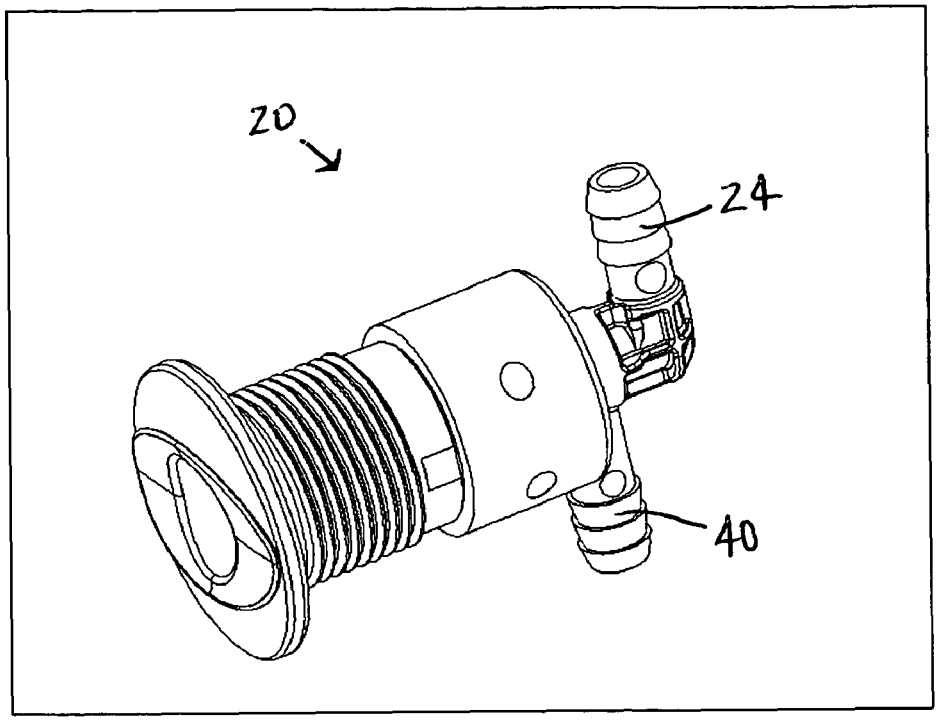
FIGS. 4A-4B show in respective perspective and cross-sectional views of a prototype of the present invention in the form of a "high air entrainment rate" commercial spa jet in which D=0.15 inches, ID=0.17 inches, DOD=0.44 inches and d=0.22 inches and $\theta$=90 degrees.
Figure 4B:
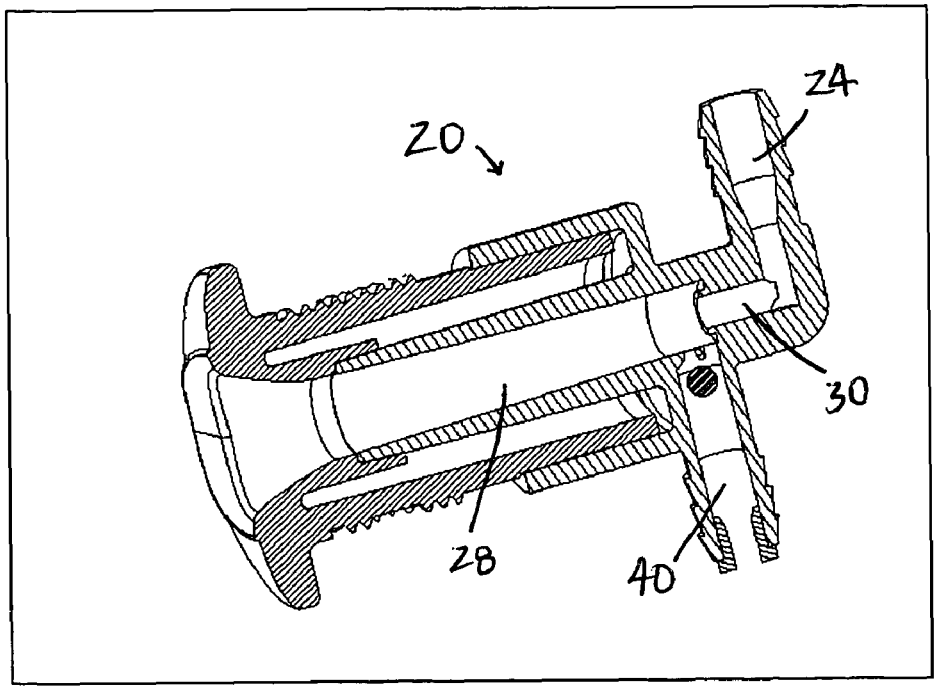

Shown in FIGS. 4A-4B in respective perspective and cross-sectional views is a prototype of the "high air entrainment rate (i.e., E>2)" commercial spa jet which is meant to be operated at a water inlet pressure of approximately 13 psi and which is constructed using the above given dimension and preferred ratios.

Since the present invention is more generally directed to developing improvements to current hydrotherapy pool technology which will provide for the users of such pools novel tactile sensations which the pool manufacturers can use to distinguish their pools from those of their competitors, the research behind the present invention also extended to how to temporally control such spa nozzles—both those that utilize the high air entrainment rate spa nozzles disclosed herein and those that use other currently available spa nozzles.

This research has led to the further discovery of how to utilize or add to a spa nozzle a simple, commercially available, fluid flow devices that are known as fluidic oscillators (so named because they are configured such that the flow from them is not steady in that its direction is continuously changed in a cyclic or oscillating manner) to uniquely regulate the temporal outputs of spa nozzles. Fluidic oscillators are themselves well known in the art for their ability to provide a wide range of liquid spray patterns without utilizing any moving parts. They accomplish this by creating flow phenomena in the oscillators that result in the cyclical deflection of the direction of the liquids that sprayed from the oscillators.

The typical fluidic oscillator or insert is generally portrayed as a thin, rectangular member that is molded or fabricated from plastic and has an especially-designed liquid flow channel (i.e., a fluidic circuit) fabricated into either its broader top or bottom surface (sometimes both). A liquid pathway through such an oscillator is formed by inserting it into the cavity of a housing whose inner walls are configured to form a liquid-tight seal around the oscillator surface having the fluidic circuit. Pressurized liquid enters such an insert and is sprayed from it. Although it is more practical from a manufacturing standpoint to construct these inserts as thin rectangular members with flow channels in their top or bottom surfaces, it should be recognized that a fluidic oscillator can be constructed so that its fluidic circuit is placed, not on a boundary surface, but actually in the interior of the member in the form of especially designed fluid pathways that run through it.

Figure 5:
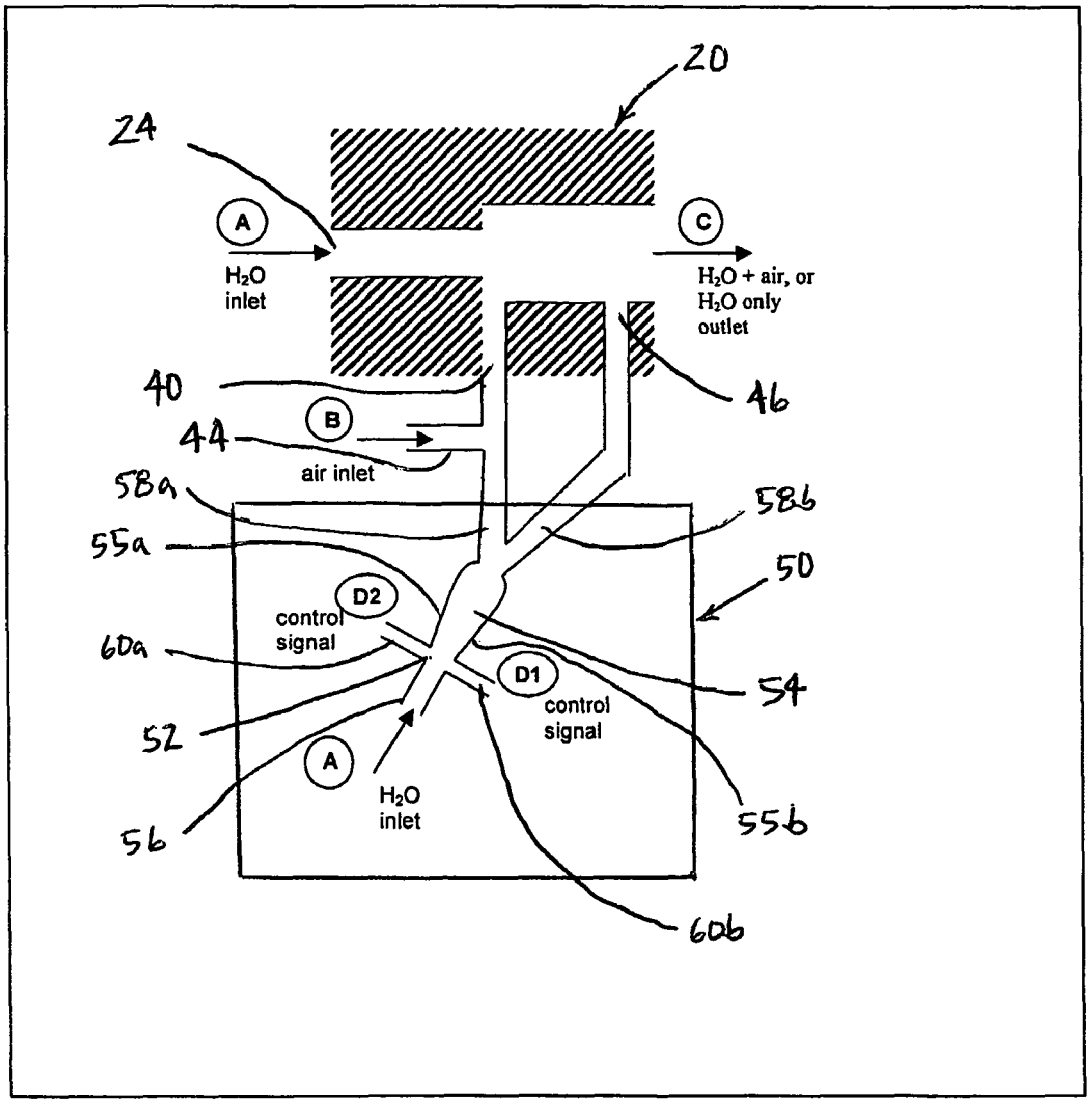
FIG. 5 illustrates a preferred embodiment for the control means of the present invention in which a fluidic oscillator is used to control the process of air entrainment into a spa nozzle.

In the present invention, we have used a fluidic oscillator to yield the improved embodiment of the present invention shown in FIG. 5. In this embodiment, the fluidic oscillator 50 is portrayed in the standard manner (i.e., a rectangular member with a fluidic circuit embedded in its top surface and its cover plate removed as to reveal the circuit's geometry) and its use is illustrated by showing a cross-sectional view of an air entraining spa nozzle whose operation it helps to regulate and control.

Key features for a preferred embodiment of a fluidic circuit that is suitable for use with the present device include: at least one power nozzle 52 configured to accelerate the movement of the liquid that flows under pressure through the device, a downstream interaction chamber 54 through which the liquid flows and in which the fluid flow phenomena is initiated that will eventually lead to the flow from the insert or device being of an oscillating nature (i.e., the jet from the power nozzle alternately attaches to the chamber's top 55*a* sidewall and then its bottom 55*b* sidewall), a liquid source inlet 56, two outlets or conduits 58*a*, 58*b* from which alternately flow the jets that have respectively attached to either the chamber's bottom 55*b* or top 55*a* sidewalls, and two gas input control ports 60*a*, 60*b*, one of which is located on either side of the power nozzle's outlet and proximate the beginning of the interaction chamber 54.

It should be noted that alternatives designs exist for a fluidic circuit that would be suitable for use in the present device. For example, in one of these, it has been possible to eliminate the pronounced interaction chamber 54 that is shown above.

The spa nozzle whose flow this fluidic device controls has the traditional elements of a water inlet 24, a diffuser 28 which has an abrupt expansion at its entrance 34, and an air inlet 40 proximate the diffuser's entrance. The entrainment line 44 for the air inlet is seen to have connected to it one 58*a* of the fluidic's outlets.

The gas input control ports 60*a*, 60*b* are used to cause the liquid jet from the power nozzle to attach to either the chamber's top 55*a* or bottom 55*b* sidewall. As the jet exits the power nozzle, its centerline is unsteady as the jet wants to entrain the otherwise stagnant air on either side of it. When one of the control ports is used to supply the needed air to one side of the jet, it allows the jet to move away from this port and attach itself to the opposite sidewall of the chamber 54.

Although the fluidic insert or oscillator has been shown in FIG. 5 as a separate unit, it should be noted that such a device could be fabricated as an integral part of this spa nozzle.

The fluidic insert is used to divert its outlet water flow to either the air inlet's entrainment line 44 or to a port 46 that empties into a downstream part of the nozzle's diffuser (note: it need only empty, it doesn't have to empty into the diffuser) depending on the signal supplied to control ports 60*a*, 60*b*. If the water is diverted to the air entrainment line 44, then the air entrainment is stopped, thus only water exits thru the diffuser's outlet. However, if the fluidic's output water is diverted to the port 46 in the diffuser, then air is once again free to rush in thru the entrainment line 44.

Figure 6:
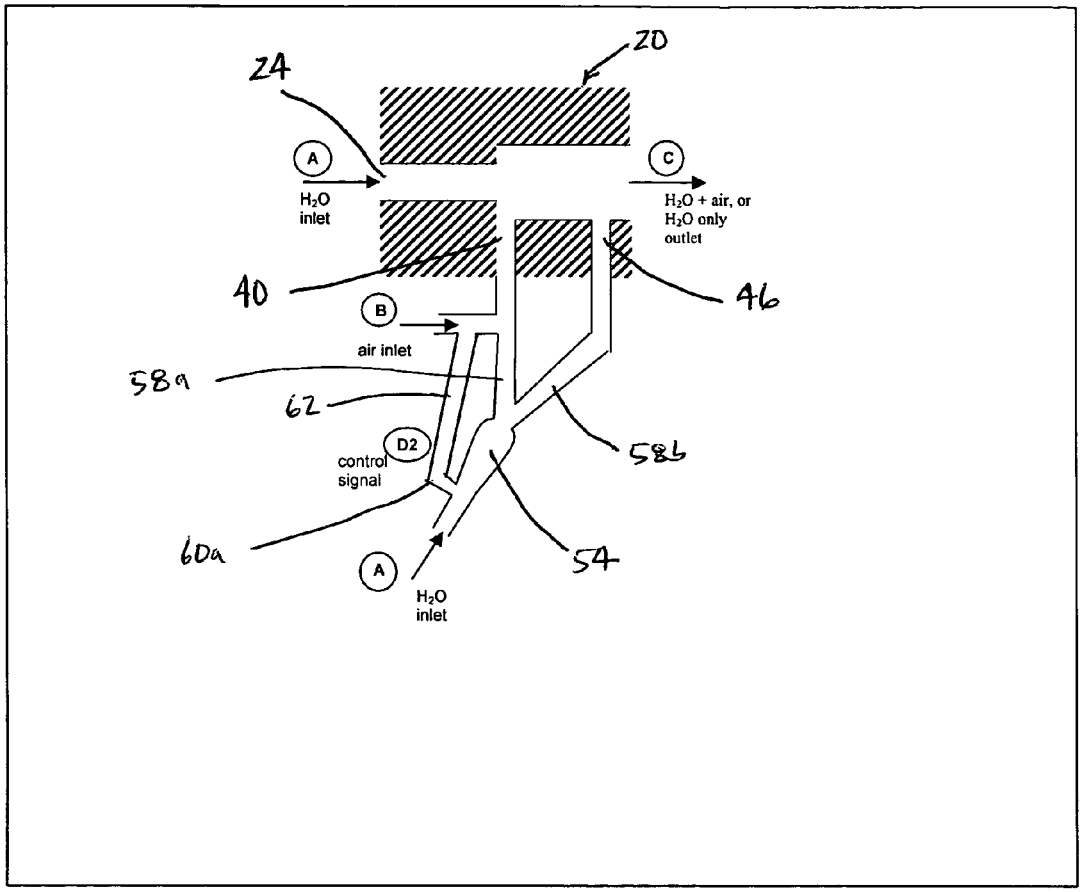
FIG. 6 shows a schematic illustration of a preferred means for cycling the process by which entrained air is allowed to enter the present invention.

There are several methods to control the operation of this fluidic, and each will have its own advantages. The simplest method is to turn the fluidic insert into a self exited oscillator, see FIG. 6. The spa nozzle's output will then be pulsing between air entrainment ON and air OFF. This mode can be accomplished by biasing the fluidic insert to direct its outlet water flow to empty to into the diffuser by eliminating the lower control port 60*b*. The remaining control port 60*a* is connected by utilizing an appropriately configured connection or control port link 62 to the air inlet entrainment line 44. Thus, when the nozzle is first turned on, the bias will divert the fluidic water to outlet that directs the fluidic's water into the diffuser, thus air will be entrained thru its entrainment line 44. But if air is being entrained, the fluidic control port 60*a* will have air and will thus divert the fluidic's water to its output 58*a* which is connect to the air entrainment line 44 thereby stopping air entrainment. Now there is no air at the fluidic control port 60*a*, and the bias will divert fluidic water back to outlet 58*b* that empties into the diffuser thereby allowing air to again be entrained through its entrainment line 44, thus beginning another cycle of entrainment air ON-OFF operation. It can be noted that the frequency of this oscillation will be function of the resistance to air flow that exits within the control port 60*a*.

We can add user adjustability by adding a flow control valve in the connection link 62. This will allow the user to select between constant air entrainment ON, constant air entrainment OFF, or the analog adjustability of the air entrainment pulsing frequency of the nozzle by using the valve to adjust the effective resistance in the control port.

Figure 7:
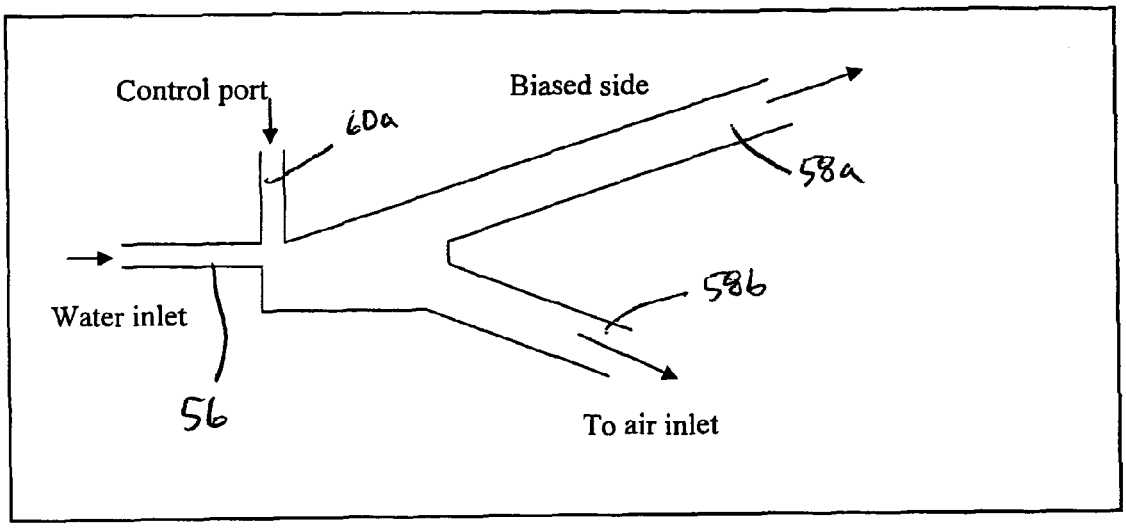
FIG. 7 shows a schematic representation of a fluidic oscillator that has been biased to output water through only one of its output ports

Several fluidic circuit designs may be employed in such a pulsating nozzle. For example, the fluidic's cross-over interaction region 54 shown in FIG. 5 is optional. The use of a cross-over interaction region is largely influenced by the position of air entrainment inlet line 44 relative to control port 60*a*. See FIG. 7 for an example of a fluid circuit having a biased water outlet and no interaction region.

Figure 8:
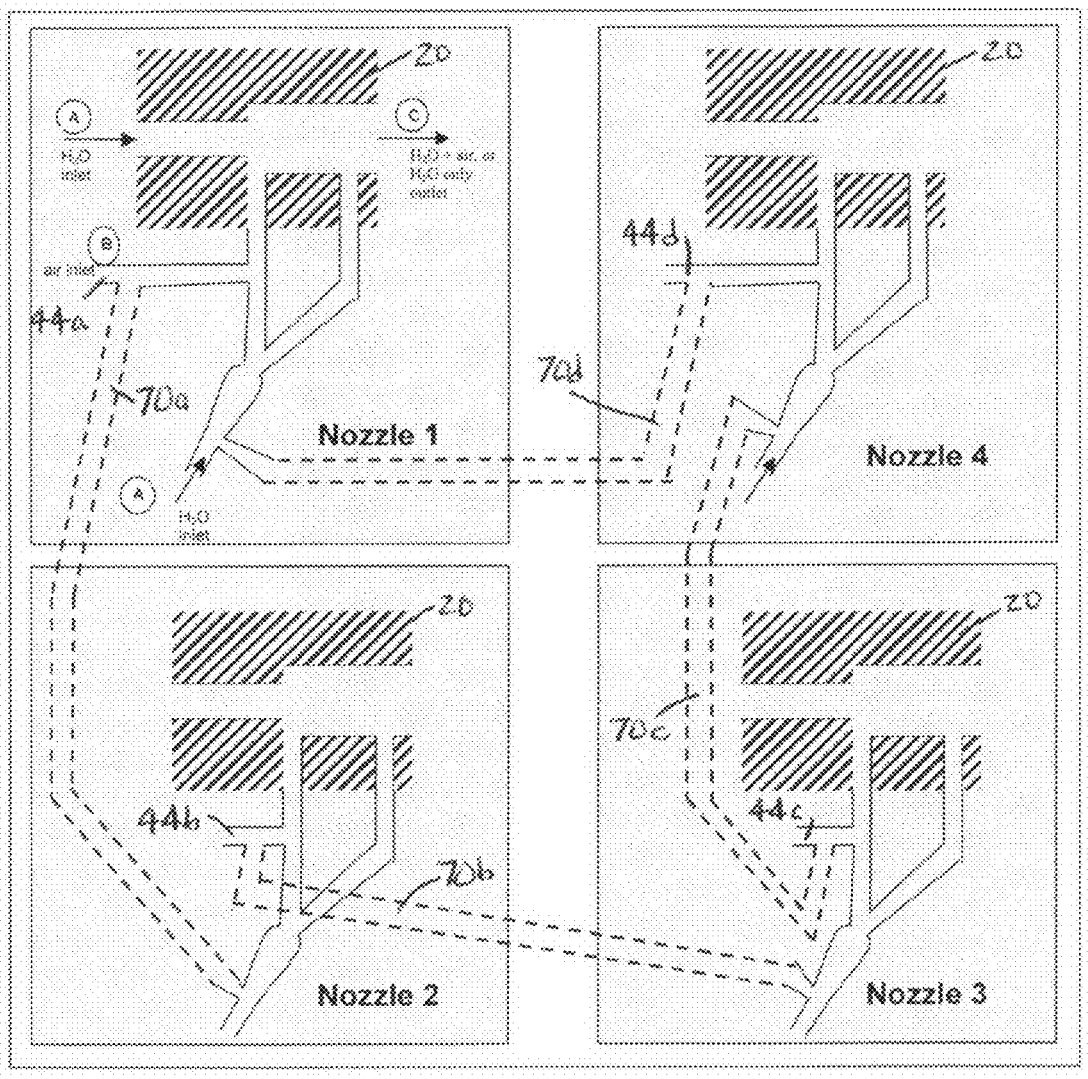
FIG. 8 illustrates how fluidic oscillators can be arranged so as to cause the sequential turning on or off the air that is allowed to be entrained into a series of spa nozzles.

It is also possible to connect multiple spa nozzles (e.g., connected by adding or providing a second, third and fourth spa nozzle in combination with the spa nozzle previously discussed) using appropriate fluidic interconnections so as to cause the air entrainment operations within these nozzle to operate in sequence. There are several ways to create this operating scheme, which we call a "master/slave" arrangement. The example presented in FIG. 8 is that of a "slave" only arrangement. The four fluidic oscillators or fluidics shown here (i.e., configuring a second fluidic oscillator for use with the second spa nozzle, configuring a third fluidic oscillator for use with the third spa nozzle and configuring a fourth fluidic oscillator for use with the fourth spa nozzle) are biased to their adjacent nozzle's diffuser ports, with the exception of Nozzle 1 which is biased to the air entrainment inlet line of its adjacent nozzle. Four air entrainment line feedback lines 70*a*-70*d* are utilized or configured such that they connect their nozzle's air entrainment line 44*a*-44*d* to the control port of the fluidic that controls the operation of the adjoining nozzle. The connections repeat until the last nozzle closes the loop by returning to the first nozzle. In FIG. 8 there are four nozzles connected, but there is no limit to the number of nozzles that can be interconnected.

The resulting sequential pattern will be that one by one all of the nozzles will turn air entrainment ON until all are ON. Then, one by one all will turn air entrainment OFF until all are OFF; the cycle then repeats.

The ultimate embodiment of this control system may be considered to be the integration of electronics into the operation of the control ports of a fluidic which regulates the air entrainment aspects of the spa nozzle to which the fluidic is attached. Temporally controlling the operation of such ports yields what we refer to as a "Smart Jet", see FIG. 9.

Figure 9:
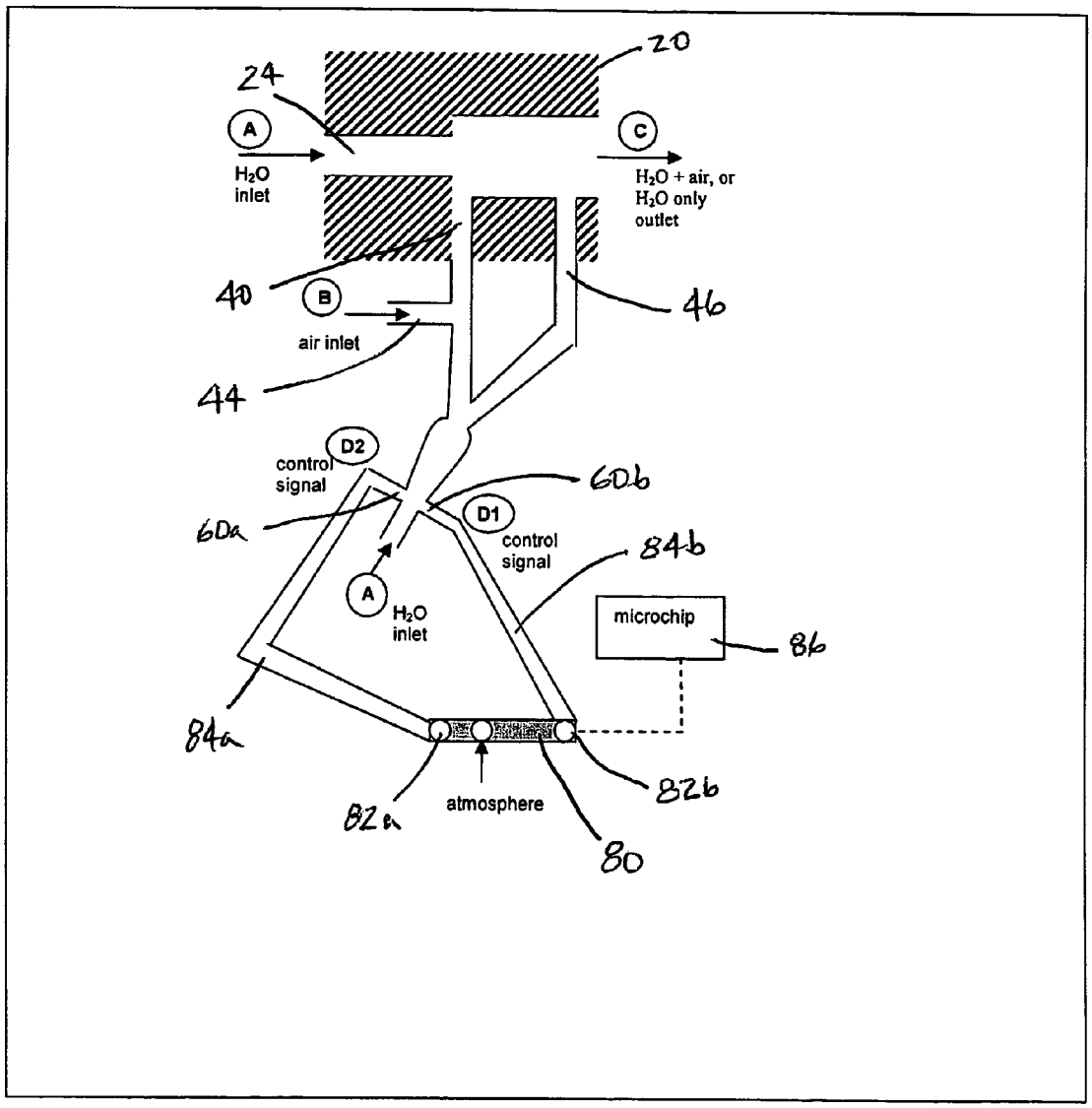
FIG. 9 illustrates how a solenoid valve can be used to temporally control a fluidic oscillator that regulates when entrained air can be taken into a spa nozzle that is herein referred to as a "Smart Jet."

Shown in FIG. 9 is a miniature, three-way air solenoid 80 whose outputs 82*a*, 82*b* are connected by links 84*a*, 84*b* to the control ports 60*a*, 60*b* of a fluidic oscillator that controls the air entrainment in an adjoining spa nozzle. The control ports' ability to allow or block air entrainment is regulated by the three-way solenoid valve whose operation can be electronically actuated by a programmable microchip 86 so as to allow entrained air from the surrounding environment to be directed to either the top 60*a* or bottom 60*b* control port.

It can also be noted that the use of a fluidic device in this application allows for the use of a small solenoid which has a low current draw. Trying to execute a similar concept (i.e., control the air entrainment lines directly) without a fluidic would require a larger solenoid with higher current draw. Appropriate electronic circuitry for the solenoid valve allows it to be programmed so that its temporal operation can be controlled to as to provide any desired sequencing for allowing air to enter the fluidic's control ports.

Figure 10:
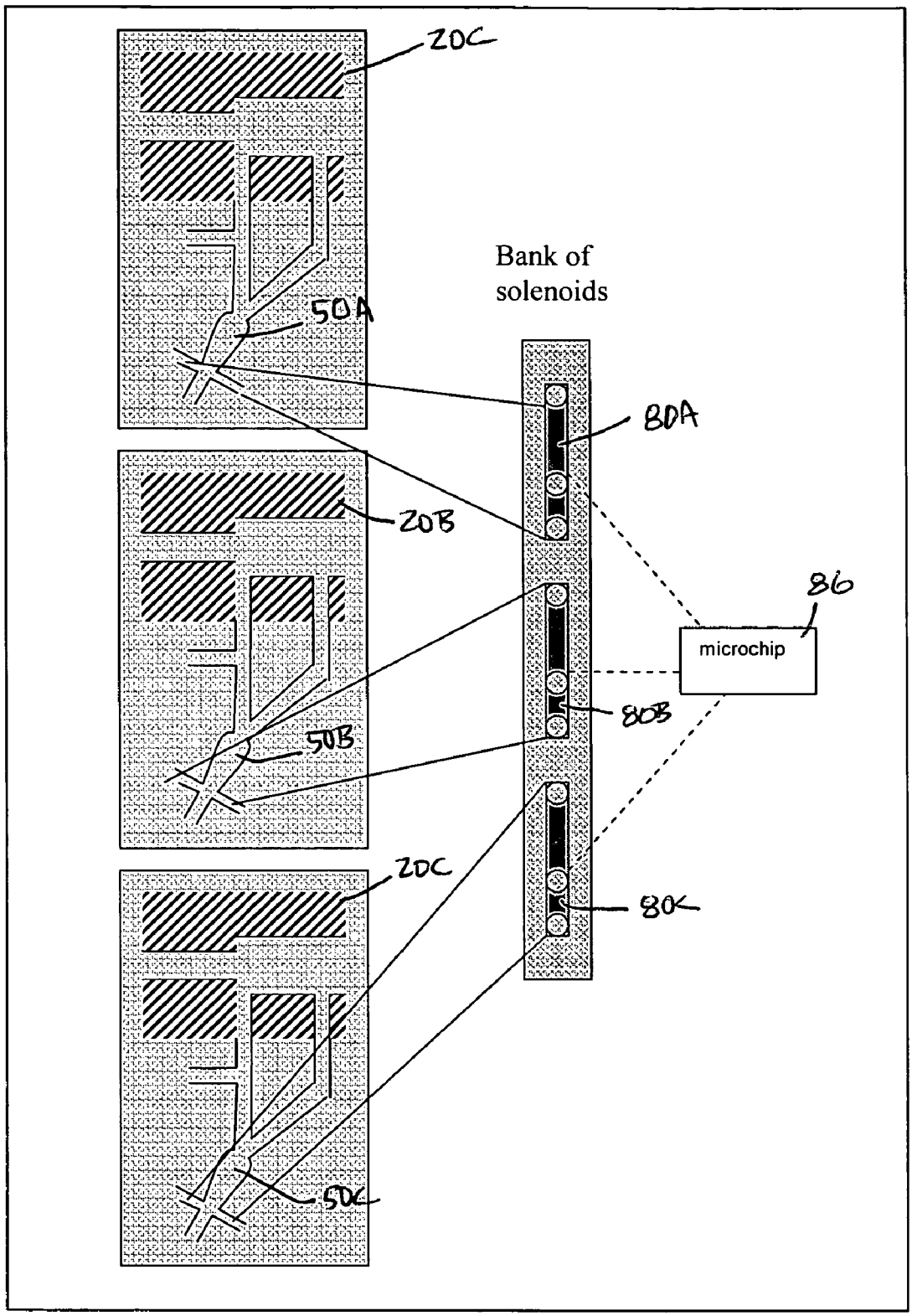
FIG. 10 illustrates how a single programmable microchip can be used to control an array of "Smart Jets" so as to create what is herein referred to as a "Smart Seat".

It is relatively simple to duplicate this control system so as allow it to control an array of Smart Jets that are all tied into a single microchip which provides user adjustable frequency and sequences; we call such an arrangement a "Smart Seat". In FIG. 10 is shown such a "Smart Seat" with three "Smart Jets," each with its own solenoid, and one microchip controlling the entire array. An infinite number of sequences can be programmed. The frequency and duty ratio can be controlled by the user. Also, the nozzle can be designed so that when air is OFF the thrust from the jet will be below a type of "feel" threshold that will cause the user to perceive no water emitting from the nozzle. Thus, one can achieve the perception of completely shutting-off the nozzles.

Figure 11:
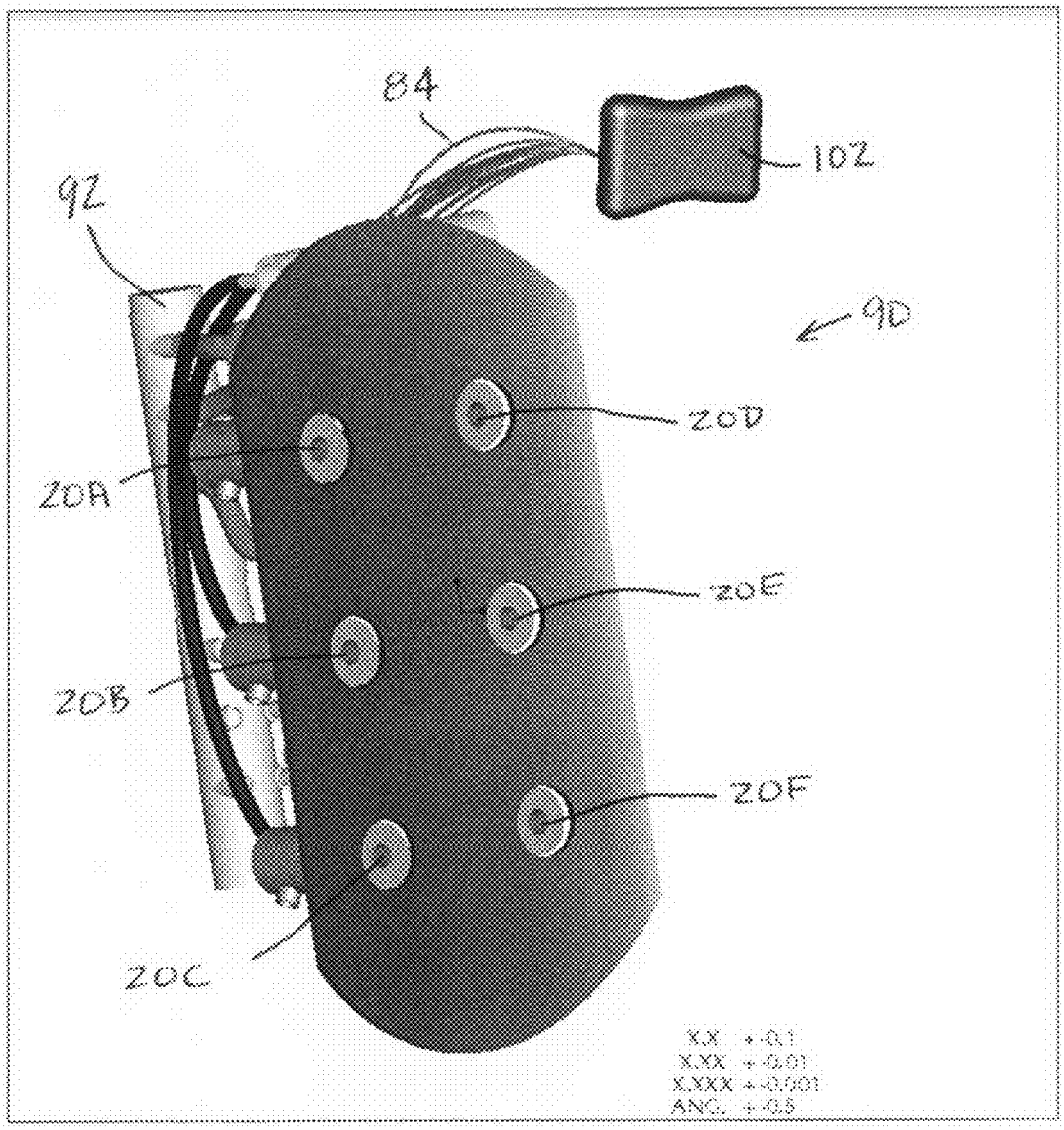
FIG. 11 shows a front, perspective view of a preferred embodiment of such a "Smart Seat".
Figure 12:
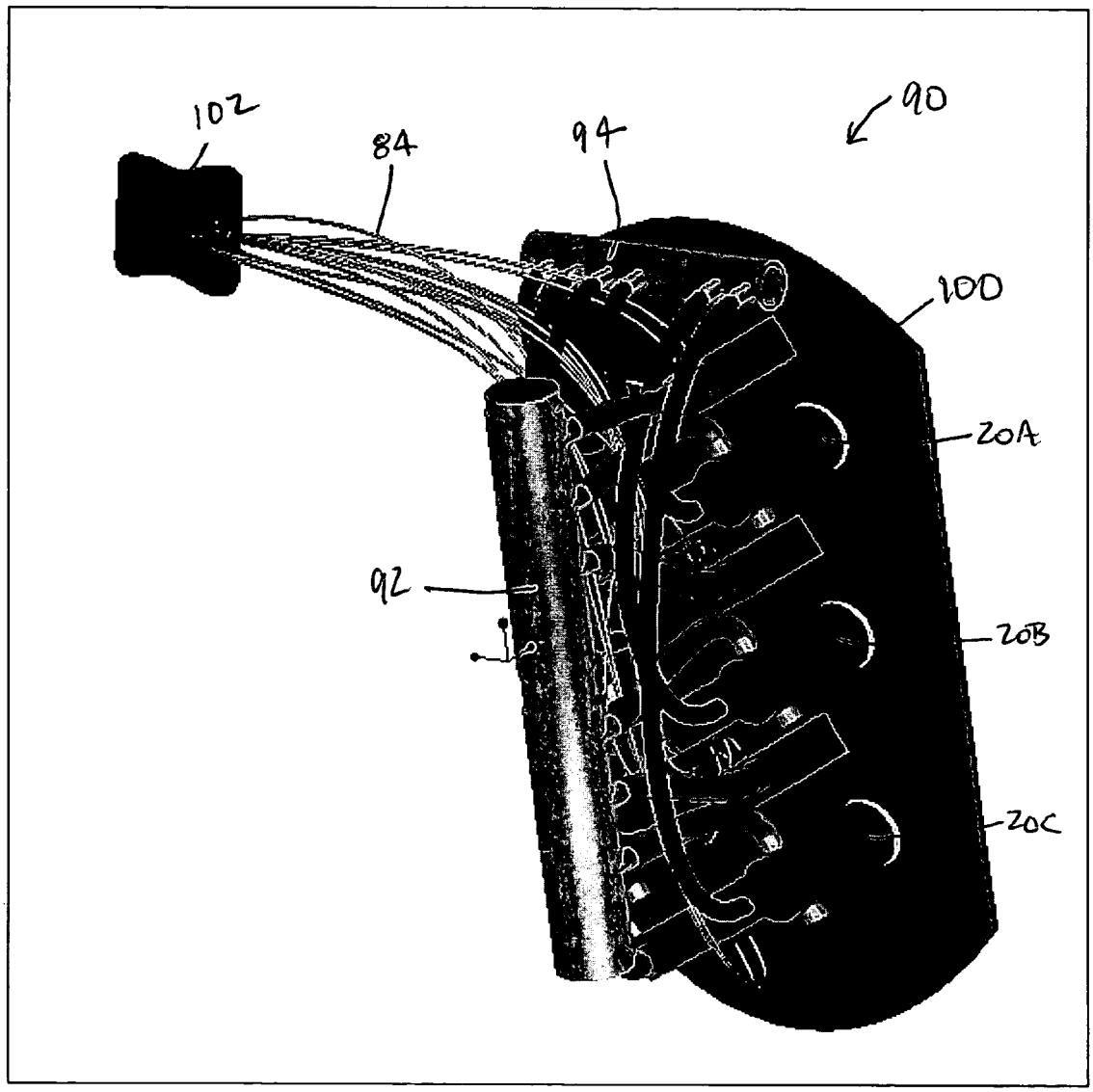
FIG. 12 shows a rear, perspective view of the "Smart Seat" shown in FIG. 11.

FIG. 11 shows a front, perspective view of a preferred embodiment of such a "Smart Seat" 90 that is suitable for insertion in the sidewall of a hot tub, spa, whirlpool, etc. It uses a single water pump and appropriate piping, including a header 92, to supply six spa jets 20A-F and their six cooperating, solenoid-controlled, fluidic oscillators. The air inlets for these are tied together by a single air manifold 94. A separate solenoid and its respective pair of air hoses 84 is used to control each of these oscillators. A single set of electronic circuitry and its control panel is used to control the operation of each of these solenoid valves. Also shown is a mounting member 100 on which the various elements are mounted and which severs as a cover plate for an opening which is placed in the tub's sidewall to accommodate this "Smart seat". The outlets for the spa jets are seen to be visible in the mounting board's front face. The fluidic device' controlling solenoid valves are mounted in a control housing 102 that also includes the solenoids' electronic circuitry and at least the connections to a control panel, if not the control panel itself. FIG. 12 shows a rear, perspective view of this same "Smart Seat".

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention that is hereinafter set forth in the claims to this invention.

We claim:

1. An improved spa nozzle that is capable of entraining air from the surrounding environment, said nozzle of the type having a water input conduit which has a centerline and a characteristic cross-sectional area dimension D, a flow output conduit having a boundary wall and an entry characteristic cross-sectional area dimension of DID, a transition conduit having characteristic cross-sectional area and length dimensions of ID and PL and which has a centerline and which connects said input and output conduits, an air entrainment conduit and wherein the centerlines of said water input and transition conduits have an intersection angle of θ, and wherein the following ratios are herein defined to describe the relative geometry of said nozzle: $\alpha$=PL/(DID −ID), $\beta$=DID/ID and $\gamma$=D/ID, said improvement comprising:

said air entrainment conduit having an outlet port in said flow output conduit boundary wall, said output and transition conduits being configured such that there is an abrupt increase in the respective sizes of their cross-sectional areas at said entry to said output conduit, said input and transition conduits being configured so that said intersection angle θ has a value in the range of 90 degrees so as to create a sharp edge at the inside corner of said input and transition conduits' intersection, said transition conduit having a relatively constant cross-sectional area at all points along said length of said transition conduit and said air entrainment conduit being configured so that said outlet port is located at a point chosen from the group consisting of at or adjacent and downstream from said entry of said flow output conduit.

2. The spa nozzle as recited in claim 1, wherein:

said water input, transition and output conduits being configured such that $\alpha$ is in the range of 1.3-5 and $\gamma$ is>1.9.

3. The spa nozzle as recited in claim 1, further comprising:

a fluidic oscillator configured to have a power nozzle and two outlet conduits downstream of said power nozzle and one or more control ports proximate said power nozzle and attached to said power nozzle so as to control the downstream flow of liquid through said power nozzle, and wherein one of said outlet conduits being connected to said air entrainment conduit.

4. The spa nozzle as recited in claim 3, further comprising:

a control port link that connects one of said oscillator control ports and said air entrainment conduit at a point upstream of said connection of said outlet with said air entrainment conduit, and wherein said power nozzle having an exit that is configured to bias the flow from said power nozzle into said outlet that is not connected to said air entrainment conduit.

5. The spa nozzle as recited in claim 4, further comprising:

a control valve in said connection link that is configured to regulate the air flow through said link.

6. The spa nozzle as recited in claim 3, further comprising:

a second spa nozzle of the type having a water input conduit, a flow output conduit, a transition conduit and an air entrainment conduit, a second fluidic oscillator configured to have a power nozzle and two outlet conduits downstream of said power nozzle and one or more control ports proximate said power nozzle and attached to said power nozzle so as to control the downstream flow of liquid through said power nozzle, wherein one of said second fluidic oscillator outlet conduits being connected to said air entrainment conduit of said second spa nozzle, wherein said first fluidic oscillator that regulates the air entrainment of said first spa nozzle is further configured such that its power nozzle has an exit that is configured to bias the flow from said power nozzle into said outlet that is connected to said air entrainment conduit of said first spa nozzle, wherein said second fluidic oscillator that regulates the air entrainment of said second spa nozzle is further configured such that its power nozzle has an exit that is configured to bias the flow from said power nozzle into said outlet that is not connected to said air entrainment conduit of said second spa nozzle, a first air entrainment feedback line that connects said first spa nozzle air entrainment conduit at a point upstream of said connection with said first oscillator outlet with said control port of said second oscillator that is proximate said outlet of said second oscillator that connects with said air entrainment conduit of said second spa nozzle, and a second air entrainment feedback line that connects said second spa nozzle air entrainment conduit at a point upstream of said connection with said second oscillator outlet with said control port of said first oscillator that is proximate said outlet of said first oscillator that does not connect with said air entrainment conduit of said first spa nozzle.

7. The spa nozzle as recited in claim 3, further comprising:

a solenoid valve having an air entrainment port and two air output ports, a pair of links that connect each of said solenoid output ports to one of said fluidic oscillator control ports, and a programmable microchip that is connected to said solenoid valve and controls the operation of said valve so as to regulate the air through said control ports of said oscillator.

8. A method for fabricating an improved spa nozzle that is capable of entraining air from the surrounding environment, said nozzle of the type having a water input conduit which has a centerline and a characteristic cross-sectional area dimension D, a flow output conduit having a boundary wall and an entry characteristic cross-sectional area dimension of DID, a transition conduit having characteristic cross-sectional area and length dimensions of ID and PL and which has a centerline and which connects said input and output conduits, an air entrainment conduit and wherein the centerlines of said water input and transition conduits have an intersection angle of $\theta$, and wherein the following ratios are herein defined to describe the relative geometry of said nozzle: $\alpha$=PL/(DID–ID), $\beta$=DID/ID and $\gamma$=D/ID, said method comprising the steps of:

configuring said air entrainment conduit to have an outlet port in said flow output conduit boundary wall, configuring said output and transition conduits such that there is an abrupt increase in the respective sizes of their cross-sectional areas at said entry to said output conduit, configuring said input and transition conduits so that said intersection angle $\theta$ has a value in the range of 90 degrees so as to create a sharp edge at the inside corner of said input and transition conduits' intersection, configuring said transition conduit so as to have a relatively constant cross-sectional area at all points along said length of said transition conduit and configuring said air entrainment conduit so that said outlet port is located at a point chosen from the group consisting of at or adjacent and downstream from said entry of said flow output conduit.

9. The method for fabricating a spa nozzle as recited in claim 8, further comprising the step of:

further configuring said water input, transition and output conduits such that a is in the range of 1.3-5 and $\beta$ is>1.9.

10. The method for fabricating a spa nozzle as recited in claim 8, further comprising the step of:

configuring a fluidic oscillator to have a power nozzle and two outlet conduits downstream of said power nozzle and one or more control ports proximate said power nozzle and attached to said power nozzle so as to control the downstream flow of liquid through said power nozzle, and wherein one of said outlet conduits being connected to said air entrainment conduit.

11. The method for fabricating a spa nozzle as recited in claim 10, further comprising the step of:

configuring a control port link to connects one of said oscillator control ports and said air entrainment conduit at a point upstream of said connection of said outlet with said air entrainment conduit, and wherein said power nozzle having an exit that is configured to bias the flow from said power nozzle into said outlet that is not connected to said air entrainment conduit.

12. The method for fabricating a spa nozzle as recited in claim 11, further comprising the step of:

configuring a control valve for placement in said connection link to regulate the air flow through said link.

13. The method for fabricating a spa nozzle as recited in claim 10, further comprising the step of:

configuring a second spa nozzle of the type having a water input conduit, a flow output conduit, a transition conduit and an air entrainment conduit, configuring a second fluidic oscillator to have a power nozzle and two outlet conduits downstream of said power nozzle and one or more control ports proximate said power nozzle and attached to said power nozzle so as to control the downstream flow of liquid through said power nozzle, wherein one of said second fluidic oscillator outlet conduits being connected to said air entrainment conduit of said second spa nozzle, wherein said first fluidic oscillator that regulates the air entrainment of said first spa nozzle is further configured such that its power nozzle has an exit that is configured to bias the flow from said power nozzle into said outlet that is connected to said air entrainment conduit of said first spa nozzle, wherein said second fluidic oscillator that regulates the air entrainment of said second spa nozzle is further configured such that its power nozzle has an exit that is configured to bias the flow from said power nozzle into said outlet that is not connected to said air entrainment conduit of said second spa nozzle, configuring a first air entrainment feedback line to connects said first spa nozzle air entrainment conduit at a point upstream of said connection with said first oscillator outlet with said control port of said second oscillator that is proximate said outlet of said second oscillator that connects with said air entrainment conduit of said second spa nozzle, and configuring a second air entrainment feedback line to connects said second spa nozzle air entrainment conduit at a point upstream of said connection with said second oscillator outlet with said control port of said first oscillator that is proximate said outlet of said first oscillator that does not connect with said air entrainment conduit of said first spa nozzle.

14. The method for fabricating a spa nozzle as recited in claim 10, further comprising the step of:

configuring a solenoid valve to have an air entrainment port and two air output ports, configuring a pair of links to connect each of said solenoid output ports to one of said fluidic oscillator control ports, and configuring a programmable microchip to connect to said solenoid valve and controls the operation of said valve so as to regulate the air through said control ports of said oscillator.

15. An improved spa nozzle that is capable of entraining high air flow rates from the surrounding environment, said nozzle of the type having a water input conduit which has a centerline, a flow output conduit having a boundary wall, an entry and a cross-sectional area, a transition conduit having a centerline, a cross-sectional area and a length and which connects said input and output conduits, and an air entrainment conduit, said improvement comprising:

said air entrainment conduit having an outlet port in said flow output conduit boundary wall said output and transition conduits being configured such that there is an abrupt increase in the respective sizes of their cross-sectional areas at said entry to said output conduit, said transition conduit having a relatively constant cross-sectional area at all points along its length, said air entrainment conduit being configured so that said outlet port is located at a point chosen from the group consisting of at or adjacent and downstream from said entry of said flow output conduit, and a means for generating a prescribed amount of vorticity in the water that flows through said nozzle at a point upstream of said entry to said output conduit, wherein said prescribed amount of vorticity being sufficient to yield a high entrainment air flow rate.

* * * * *